US007296789B2

(12) United States Patent
Fujii et al.

(10) Patent No.: US 7,296,789 B2
(45) Date of Patent: Nov. 20, 2007

(54) SHEET FEEDER, IMAGE READING APPARATUS, AND IMAGE FORMING APPARATUS

(75) Inventors: Shuhji Fujii, Kyoto (JP); Kaoru Ishikura, Kyoto (JP); Takashi Imai, Nara (JP); Osamu Fujimoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 586 days.

(21) Appl. No.: 10/876,341

(22) Filed: Jun. 24, 2004

(65) Prior Publication Data

US 2005/0023743 A1 Feb. 3, 2005

(30) Foreign Application Priority Data

Jul. 2, 2003 (JP) ..... 2003-190650

(51) Int. Cl.
*B65H 1/00* (2006.01)

(52) U.S. Cl. ..... 271/10.02; 271/10.03; 271/258.01; 271/152; 271/154; 271/157

(58) Field of Classification Search ..... 271/3.13, 271/3.14, 3.15, 3.17, 4.02, 4.03, 10.01, 10.02, 271/10.03, 258.01, 259, 152, 153, 154, 155, 271/157; 399/367, 371

See application file for complete search history.

(56) References Cited

U.S. PATENT DOCUMENTS 5,716,046 A * 2/1998 Katamoto et al. ..... 271/3.08
6,091,927 A 7/2000 Hattori et al.
6,806,946 B2 * 10/2004 Otaki ..... 355/407

FOREIGN PATENT DOCUMENTS

JP 11-199065 7/1999
JP 2000-038241 2/2000

* cited by examiner

*Primary Examiner*—David H Bollinger
(74) *Attorney, Agent, or Firm*—Renner, Otto, Boisselle, Sklar, LLP

(57) ABSTRACT

It is determined whether or not a jammed document is necessarily returned to a document tray when a jam of the document is caused within a carrier path and, then, the elevation operation of the document tray is controlled on the basis of its result of the determination. Since the jammed sheet of which reading has not been completed should be returned to the document tray, the document tray is moved down. Since the jammed sheet of which reading has been completed should not be returned to the document tray, the document tray is maintained at a position as it is. When the apparatus stops due to the carrying jam, a time required for processing the document is shortened.

21 Claims, 10 Drawing Sheets

SHEET FEEDER, IMAGE READING APPARATUS, AND IMAGE FORMING APPARATUS

CROSS-REFERENCE TO RELATED APPLICATIONS

This Nonprovisional application claims priority under 35 U.S.C. §119(a) on Patent Application No. 2003-190650 filed in Japan on Jul. 2, 2003, the entire contents of which are hereby incorporated by reference.

BACKGROUND OF THE INVENTION

The present invention relates to a sheet feeder which is equipped with an image reading apparatus such as a copying machine or a scanner or an image forming apparatus such as a printer or a facsimile machine and which sequentially takes out sheets of document contained in a sheet container in a stacked manner to feed and carry the sheets to a carrier path. The present invention also relates to an image reading apparatus and an image forming apparatus that comprise this sheet feeder.

In recent years, an image forming apparatus or the like has been provided with an apparatus for reading an image of the sheet while automatically and sequentially taking and carrying the sheets of document one by one, so that the image is efficiently read and formed. On the other hand, due to progress of a digital technology, a speed of reading an image from the document, a speed of converting the read data into the electronic data and a speed of forming an image from the electronic data rise, and this makes it possible to process more documents at a high speed. Such a reading apparatus can contain a large number of sheets in a tray (a sheet container), namely, about 100 to 200 sheets. In addition, in accordance with progress of a document carrier of the image reading apparatus, various kinds of sheets can be carried.

Thus, if the number of contained sheets is increased, in the configuration such that the height of the tray is fixed, it is difficult to make a taking-out condition of each sheet from the tray even, so that an apparatus has been known, which enables to move up and down the tray by an elevating mechanism and maintains the uppermost face of the sheet contained in the tray at a predetermined height (see, for example, Japanese Patent Application Laid-Open No.11-199065 (1999), referred as a prior apparatus below). The prior apparatus intends to acquire an advantage of improving a convenience of the containing operation of the sheet by automatically moving down the tray when feeding of the sheet is initiated and the apparatus is brought to an emergency stop in midstream of carrier path due to a carriage error such as carrying jam or the like.

In the image reading apparatus for reading the image of the sheet while containing a large number of sheets such as documents in the tray and feeding and carrying them, there is a problem such that it takes a long time from the tray is moved up till the sheet can be fed to a carrier path so as to make a total reading time till reading of the sheet is completed longer when putting a tray having a large capacity for mounting the sheet on standby, moving up the tray by a signal with respect to the key operation or the like for initiating reading of the sheet, and initiating the operation for feeding the sheet to the carrier path for carrying the sheet to a reader.

In the prior apparatus, in the case of detecting occurrence of the carrying jam of the sheet, the tray is moved down to the lowest position. Accordingly, in the case of completing the jam handling and restarting the reading operation of the image of the sheet, it is necessary to move up the tray again. When the carrying jam is caused and the image is in the middle of being read or when no image has been read and the sheet should be returned to the tray while feeding the sheet from the tray again, the tray should be moved up again. However, when it is no need to return the sheet to the tray, there is no problem if the sheet is fed without moving down the tray. The prior apparatus, since the tray is always moved down to the lowest position when the carrying jam of the sheet occurs, the tray should be moved up to a height capable of feeding the sheet therefrom upon restarting feeding of the sheet for reading, and this involves a problem such that it takes a long time.

BRIEF SUMMARY OF THE INVENTION

The present invention has been made taking the foregoing problems into consideration and an object of which is to provide a sheet feeder capable of making a time for processing of a sheet shorter by maintaining a height of a tray without moving down when there is no need to return the sheet taken out from a carrier path to the tray if the apparatus is brought to an emergency stop due to carrying jam as well as an image reading apparatus and an image forming apparatus that are provided with this sheet feeder.

The sheet feeder according to the present invention may include a sheet container for containing a plurality of sheets in a stacked manner, an elevator for moving up/down the sheet container, a sheet carrier for carrying an abutted sheet to a carrier path when the sheet container is moved up by the elevator, a carriage detector for detecting a carriage state of the sheet to be carried in the carrier path, a determination unit for determining, when a carriage error of a sheet is caused within the carrier path, whether or not the sheet suffering from the carriage error is removed from the carrier path and necessarily returned to the sheet container, and a controller for controlling whether or not the sheet container is moved down on the basis of a result of determination by the determination unit.

When the sheet feeder according to the present invention stops due to a carrying error (carrying jam) of the sheet, a sheet container may be controlled to be maintained at that position or to be moved down in accordance with a carriage state of the jammed sheet. Therefore, it is possible to avoid the wasteful operation to the sheet container, to perform efficient processing, and to reduce the processing time.

The sheet feeder according to the present invention remains the sheet container at a height as it is when the determination unit determines that the sheet is not necessarily returned to the sheet container.

In the sheet feeder according to the present invention, when it is not necessary to return the jammed sheet to the sheet container, the sheet container is maintained at that position and when it is necessary to return the jammed sheet to the sheet container, the sheet container is moved down. Therefore, in the case of restarting the sheet feeder when the carrying jam is removed, there is no need to perform the wasteful operation, and this makes it possible to efficiently perform the processing and to reduce the processing time.

The sheet feeder according to the present invention further includes a receiver for receiving a predetermined operation from the outside, and the determination unit determines whether or not the sheet is necessarily returned to the sheet container based on whether or not the receiver receives the predetermined operation.

In the sheet feeder according to the present invention, when a user performs a predetermined operation such as returning the sheet to the sheet container, the sheet container is moved down, and when the user does not perform the predetermined operation, the sheet container is maintained at that position. Therefore, as compared to the apparatus for performing the same operation (moving-down processing), the wasteful operation is not required in any case, so that it is possible to reduce the processing time and the sheet feeder can perform the efficient processing.

In the sheet feeder according to the present invention, the receiver is an elevation operation receiver for receiving an elevation operation of the sheet container, and the determination unit determines that the sheet is necessarily returned to the sheet container when the elevation operation receiver receives the elevation operation, and determines that the sheet is not necessarily returned to the sheet container when the elevation operation receiver does not receive the elevation operation.

In the sheet feeder according to the present invention, the user operates an elevation operation receiver for moving up/down the sheet container (for example, an elevation operation key) because the user thinks that the sheet should be returned to the sheet container. Therefore, when the elevation operation receiver is operated, determining that the sheet is necessarily returned to the sheet container, the sheet container is moved down. As a result, the processing of returning the sheet can be easily performed.

In the sheet feeder according to the present invention, the sheet carrier has a cover member that can be freely opened/closed and covers the carrier path and an opening/closing detector for detecting opening/closing of the cover member, and the determination unit determines whether or not the sheet is necessarily returned to the sheet container on the basis of a result of detection by the opening/closing detector.

In the sheet feeder according to the present invention, the cover member of the carrier path is necessarily opened when taking out the sheet staying on the carrier path. Therefore, when detecting that the cover member is opened, it is determined that the sheet should be returned to the sheet container, and when not detecting that the cover member is opened, it is determined that the sheet should not be returned to the sheet container. Therefore, it is possible to easily determine whether or not the sheet should be returned to the sheet container. If the cover member is opened, determining that the sheet should be returned to the sheet container, the sheet container is moved down, and if the cover member is not opened, determining that the sheet is not necessarily returned to the sheet container, the sheet container is maintained at that position.

In the sheet feeder according to the present invention, the carriage detector has a plurality of carriage detectors arranged from the upstream side to the downstream side within the carrier path, and the determination unit determines whether or not the sheet is necessarily returned to the sheet container based on whether or not a carriage detector arranged at the uppermost stream side among the plural carriage detectors detects a sheet to be carried.

In the sheet feeder according to the present invention, if the sheet reaches a carriage detector located at the most upstream side of the carrier path, determining that the sheet should be returned to the sheet container, the sheet container is moved down. If the sheet does not reach the carriage detector, determining that the sheet is not necessarily returned to the sheet container, the sheet container is maintained at that position. Thus, efficiency of the processing is intended by preventing the wasteful operation (moving-down operation).

The sheet feeder according to the present invention includes a sheet container for containing a plurality of sheets in a stacked manner, an elevator for moving up/down the sheet container, a sheet carrier for carrying an abutted sheet to a carrier path when the sheet container is moved up by the elevator, a carriage detector for detecting a carriage state of the sheet to be carried in the carrier path, and an allowing unit for allowing the moving-down operation of the sheet container by the elevator when a carriage error of a sheet is caused.

When the sheet feeder according to the present invention stops due to the carrying jam of the sheet, the sheet container may be controlled so that moving-down operation is allowed. Generally, when a trouble such as the carrying jam or the like occurs, the user is prohibited from the electronic operation; however, in the sheet feeder mounting the sheets on the sheet container and taking out the sheets from the uppermost portion of the sheet, the operation to move down the sheet container has no bad effect on the sheet, so that if making the operation to move down the sheet container available, it is possible to easily check the sheet mounted state or the like.

An image reading apparatus according to the present invention includes the sheet feeder and an image reader for reading an image on the sheet carried by the sheet carrier.

According to the image reading apparatus of the present invention, it is possible to reduce the processing time by reducing the wasteful operation when the apparatus stops due to the carrying jam and it is possible to read the image on the sheet carried by the sheet carrier.

An image forming apparatus according to the present invention includes the sheet feeder, an image reader for reading an image of the sheet carried by the sheet carrier, and an image forming unit for forming the image read by the image reader on paper.

According to the image forming apparatus of the present invention, it is possible to reduce the processing time by reducing the wasteful operation when the apparatus stops due to the carrying jam and it is possible to form the image that is read by the image reading apparatus on paper.

The above and further objects and features of the invention will more fully be apparent from the following detailed description with accompanying drawings.

DETAILED DESCRIPTION OF THE INVENTION

Embodiments of the present invention will be described in detail with reference to the drawings below.

Figure 1:
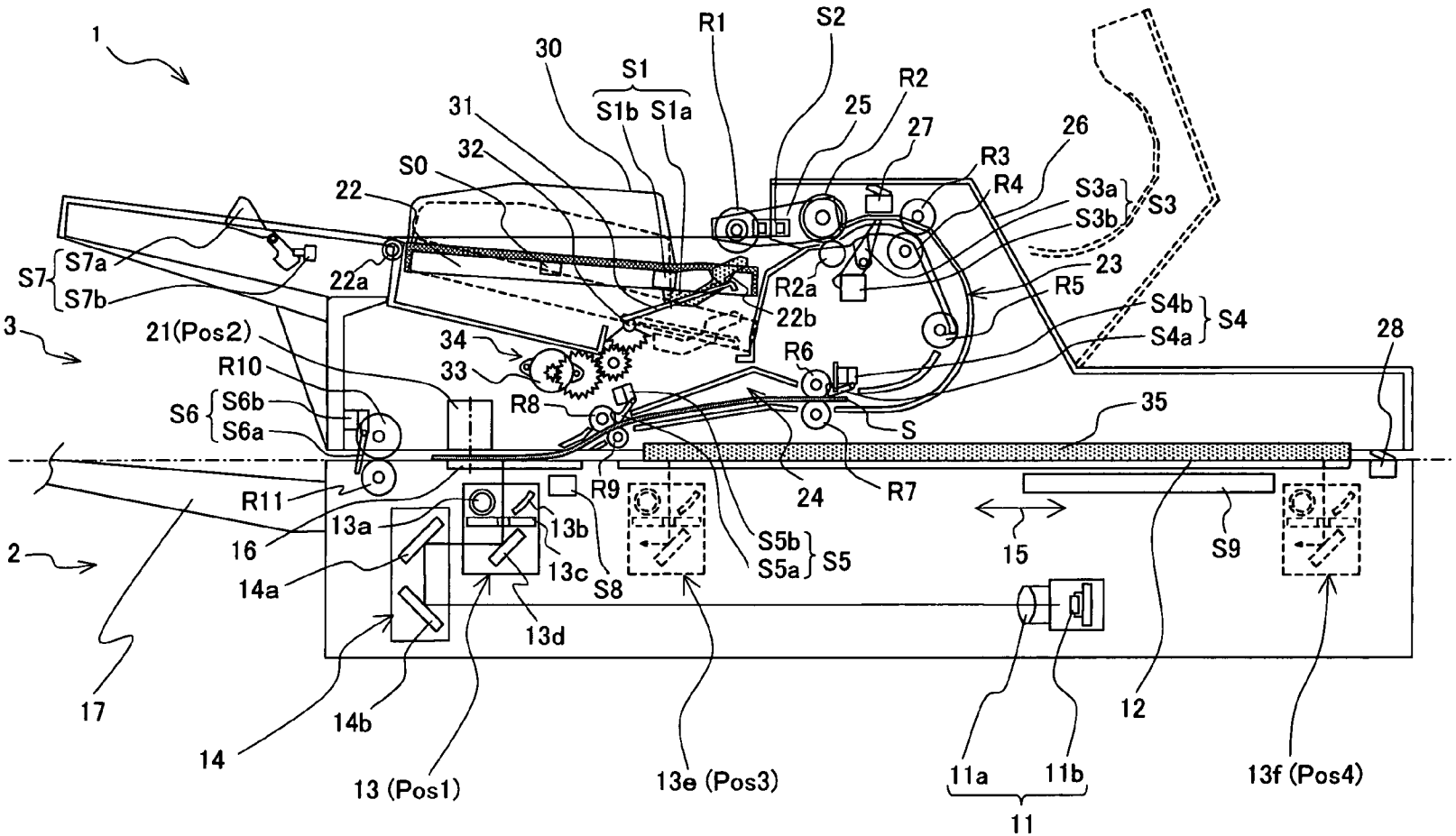
FIG. 1 is a longitudinal sectional view showing an entire structure of an image reading apparatus according to the present invention.

FIG. 1 is a longitudinal sectional view showing an entire structure of an image reading apparatus 1 of an embodiment according to the present invention. This image reading apparatus 1 is briefly structured by an optical system 2 and an ADF (Automatic Document Feeder) 3 that is arranged above the optical system 2, and this image reading apparatus 1 is used as a scanner apparatus (an image reading apparatus) capable of reading images on the opposite faces of a document for a copying machine and a facsimile machine the like.

The optical system 2 is provided with a CCD (Charge Coupled Device) reading unit 11 as a first reader, a light source unit 13, and a mirror unit 14. By using the light source unit 13 and the mirror unit 14, the image of the document mounted on a document table (platen glass) 12 and is supported on a plain is made to be read by the CCD reading unit 11 that is provided on a predetermined position. The CCD reading unit 11 is provided with an image formation lens 11*a* and a CCD 11*b*, and focuses a reflection light from the document passing through respective parts (to be described later) on the CCD 11*b* via the image formation lens 11*a*.

The light source unit 13 is provided with an exposure lamp 13*a*, a reflector 13*b* of a concave side condensing illumination light for reading to be irradiated from this exposure lamp 13*a* on a predetermined reading position on the document table 12, a slit 13*c* only passing a reflection light from the document, and a mirror 13*d* that is arranged with its reflection side at 45° against the side of the document table 12 in order to change an optical path of the light passed through the slit 13*c* by 90°. A mirror unit 14 is provided with a pair of mirrors 14*a* and 14*b* arranged in such a manner that their reflection sides are at right angles to each other in order to further change the optical path of the light by 180°, of which optical path is changed by 90° with the mirror 13*d* of the light source unit 13.

The light source unit 13, as shown by reference numerals 13*e*, 13*f* and the like, moves in an arrow direction 15 (a sub-scanning direction) in parallel with the side of the document table 12, and in the same way, the mirror unit 14 moves in the arrow direction 15 (a sub-scanning direction) in parallel with the side of the document table 12. This makes it possible to read the image of the document mounted on the document table 12. In this case, assuming that a moving rate of the light source unit 13 is V, it is necessary to make a moving rate of the mirror unit 14 V/2. In addition, the light source unit 13 and the mirror unit 14 are moved by a stepping motor 42 (see FIG. 2).

In the meantime, the CCD reading unit 11 may focus the reflection light of the irradiated from the exposure lamp 13*a* from the document on the CCD 11*b* via the image formation lens 11*a* while scanning a unit of a reduced reading optical system or a unit of an equally multiplied reading optical system at a rate V, in which at least CCD 11*b*, the image formation lens 11*a* and the exposure lamp 13*a* are configured into one unit (not illustrated).

In addition, this optical system 2 is provided with a document table 16 at a position separated in a direction of sub-scanning differently from the document table 12. The light source unit 13 can read the image of one side of the document (hereinafter, this side is referred to as a front side) carried on the document table 16 with resting below this document table 16. In the vicinity of an outlet of the document carried on this document table 16, a discharge tray 17 is provided.

On the other hand, the ADF 3 is provided with a CIS (Contact Image Sensor) 21 as a second reader at a position opposed to the document table 16. The ADF 3 may make the image of the other side of the document (hereinafter, referred to as a rear side) to be read by the CIS 21 while taking out the documents contained on a document tray 22 as a sheet container in a stacked state one by one. Therefore, the ADF 3 is further provided with various rollers R1 to R10, various detectors S0 to S7, a curved carrier path 23, and a resist skewing correction area 24. In the meantime, the CIS 21 is provided with, for example, an image sensor shaped in an array, light guiding means shaped in an array (a lens array such as a Selfoc lens) and a light source (an LED array light source or a fluorescent lamp) and the like.

Figure 2:
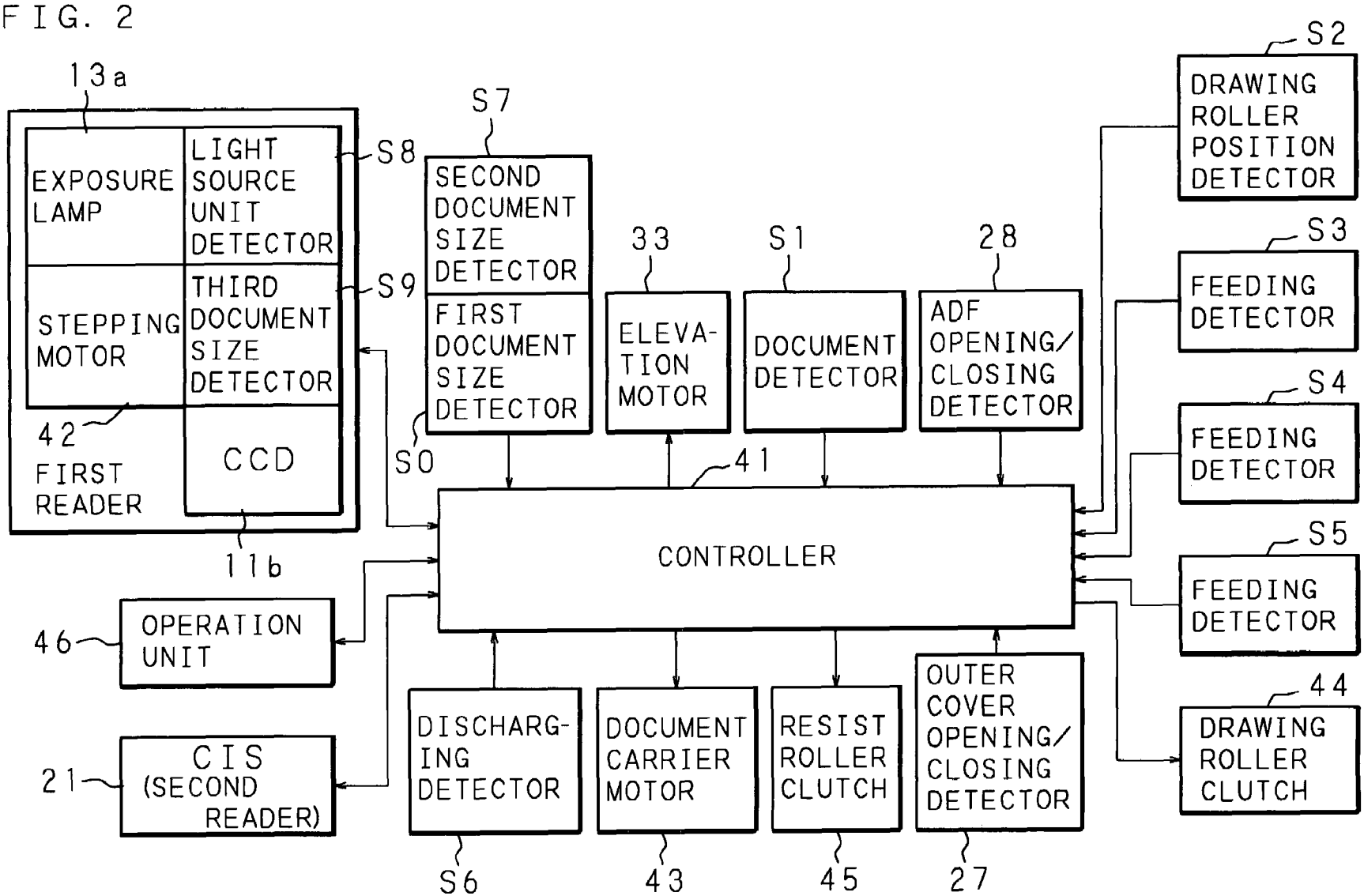
FIG. 2 is a block diagram showing a functional structure of the image reading apparatus according to the present invention.

In the meantime, various rollers R1 to R10 are driven by a document carrier motor 43 (see FIG. 2). A drawing roller clutch 44 (see FIG. 2) is connected to a drawing roller R1 as a sheet carrier and a separation roller R2 that is coupled in conjunction with this drawing roller clutch 44 by transmission means such as a belt, and a resist roller clutch 45 (see FIG. 2) is connected to one of the resist rollers R8 and R9, respectively. If these clutches 44 and 45 are blocked off by control of a controller 41 (see FIG. 2), a driving force of the document carrier motor 43 (see FIG. 2) is transmitted to or blocked off the drawing roller R1, the separation roller R2, and the resist rollers R8 and R9.

A document tray 22 of an electric motor-driven type is made into a standby state with a start key lighted when an optical document detector S1 having an actuator S1*a* and a sensor body S1*b* detects that the document is set. Further, when the document tray 22 starts to rise at a predetermined timing, the document on the uppermost layer of the mounted document bundle pushes up the drawing roller R1 supported by an arm 25 freely elevating, and a drawing roller position detector S2 detects displacement of this drawing roller R1, specifically detects that the drawing roller R1 is pushed up, the document tray 22 may stop rising and in this state, the document tray 22 may be put on standby with maintained at this height.

In the meantime, in the case of setting the document in the document tray 22 and rising the document tray 22 on standby, if the document tray 22 is left for predetermined hours with no signal to start reading inputted therein, the document tray 22 may be remained on a standby as it is. However, it is preferable that the document tray 22 moves down at a predetermined height once on standby so as to prevent transformation of the drawing roller R1.

If a document feeding start signal is inputted, when the document tray 22 is put on standby down below, rising the document tray 22 is performed till the drawing roller position detector S2 detects the drawing roller R1 and, then, the drawing roller R1 is rotationally driven and the documents on the uppermost layer of the document bundle are sequentially fed. At a downstream side of the drawing roller R1, the separation rollers R2 and R2*a* are arranged. The drawing roller R1 is supported by the arm 25 which is supported rotatably around a rotation shaft of the separation roller R2. Then, the drawing roller R1 may contact the document on the uppermost layer that is set on the document tray 22 by its own weight or an energization force. In addition, the drawing roller R1 is prevented from being moved down more than necessary by a stopper (not illustrated).

A convex portion is formed on a side of the arm 25. By detecting this convex portion by the drawing roller position detector S2 including an optical sensor or the like, it is possible to detect the height of the drawing roller R1 from a swing angle of the arm 25. In the meantime, according to the preset embodiment, providing the convex portion on the arm 25 and providing the drawing roller position detector S2 thereon, this drawing roller position detector S2 may directly detect the height of the drawing roller R1 in the present embodiment; however, the drawing roller position detector S2 may be provided separated from the arm 25. In this case, by using movable coupling means, the height of the arm 25 may be detected.

On the separation roller R2, the separation roller R2*a* provided with a torque limiter (in place of this, a friction pat is available) is provided opposed therewith. Accordingly, even if a plurality of documents is fed by the drawing roller R1, the document on the uppermost layer contacting the drawing roller R1 is only fed by the separation rollers R2 and R2*a* so as to prevent the document from being doubly fed, and this makes one document to be separated reliably. In the meantime, a feeding detector S3 may detect whether or not the documents are reliably separated and fed by the separation rollers R2 and R2*a*, which feeding detector S3 is defined as a carrier detector (a carriage detector at the uppermost side) having an actuator S3*a* and a sensor body S3*b*. Then, the documents are carried to the curved carrier path 23 at the downstream side at a predetermined timing.

In the curved carrier path 23, a feeding detector S4 that has an actuator S4*a* and a sensor body S4*b* and detects discharge of the document from the curved carrier path 23 may detect whether or not the documents are carried by carrier rollers R3 to R7 reasonably. The curved carrier path 23 has a curvature capable of carrying any kinds of document stably. Specifically, the curved carrier path 23 is configured with a curvature capable of smoothly carrying the most thick, namely, most elastic document from among the readable documents.

An outer cover 26 is provided as a cover member so as to cover the separation rollers R2 and R2*a*, the carrier rollers R3 and R4, and the curved carrier path 23. The outer cover 26 is freely opened/closed, and when the carrying jam is caused to stay the document within the curved carrier path 23, the user may open this outer cover 26 (see a broken line of FIG. 1) and may take out the document staying within the curved carrier path 23. An opening/closing state of the outer cover 26 is detected by an outer cover opening/closing detector 27.

Then, the document discharged from the curved carrier path 23 is carried to the resist skewing correction area 24. When a front end of the document is detected by a feeding detector S5 that is arranged before the resist rollers R8 and R9 set in the vicinity of the outlet of the resist skewing correction area 24, the front end of the document is crashed against a seam of the resist rollers R8 and R9 by a carriage force from the upstream side over a predetermined time with the resist rollers R8 and R9 stopped, and thereby, resist and skewing correction of the document are carried out. In the meantime, the feeding detector S5 includes an actuator S5*a* and a sensor body S5*b*.

The resist skewing correction area 24 is a segment from the last carrier roller pair R6, R7 of the curved carrier path 23 to the resist roller pair R8, R9. In this resist skewing correction area 24, a document S becomes approximately a straight line between these carrier rollers R6, R7 and the resist rollers R8, R9 and the document becomes free as much as possible from a guide surface of the carrier path so as to perform the above-described resist and skewing correction of the document. In the meantime, a distance between the carrier rollers R6, R7 and the resist rollers R8, R9 may secure at least a length in a carrier direction of the smallest document among the documents that can be processed by the document feeder. In other words, the more a rear end portion of the document staying within the curved carrier path 23 is shorter, the more the resist and the skewing correction of the document can be performed smoothly.

The document applied with the resist and the skewing correction in the resist skewing correction area 24 restarts to be carried at a predetermined timing; this document is carried to a first reading position Pos1 for exposure-scanning a front side of the document, and then, the document passes through a second reading position Pos2 for exposure-scanning a rear side of the document. The light source unit 13 and the CIS 21 face to the first reading position Pos1 and the second reading position Pos2, respectively.

Thus, the document having read its front side or both front and rear sides may be discharged on the discharge tray 17 that is supported lower than a document discharge position of a side of the document reading apparatus 1 by the discharge rollers R10 and R11 (however, the discharge roller R11 is provided at the side of the optical system 2). A discharging detector S6 having an actuator S6*a* and a sensor body S6*b* may detect whether or not the discharge operation of the document to this discharge tray 17 is checked.

Sequentially repeating the above-described operations till the documents set on the document tray 22 are all removed, all of the completely read documents are sequentially discharged on the discharge tray 17.

In the meantime, since the height of the document bundle is gradually lowered when the documents on the document tray 22 are sequentially fed, by rising the document tray 22 for a moving down position of the drawing roller R1, the document tray 22 is controlled so that the uppermost side of the document bundle and the drawing roller R1 can always maintain a predetermined height. Therefore, the document tray 22 can be swung around a supporting point 22*a*; however, the document tray 22 can rise by pushing up a rib 22*b* that is provided at an end at the opposite side of the supporting point 22*a* by an elevation plate 31 and, in addition, a rib 22*b*, namely, the document tray 22 falls down by moving down the elevation plate 31 on the contrary. The end at the opposite side of the rib 22*b* of the elevation plate 31 is secured to a plate supporting shaft 32, and this plate supporting shaft 32 is rotatably driven by an elevation motor 33 via an elevation mechanism 34 having a transmission member (gear) row. An elevator for moving up/down the sheet container (the document tray 22) is configured by these elevation motor 33, elevation mechanism 34 and the like.

A position of the document tray 22 on standby is maintained by controlling the driving of the elevation motor 33 of the elevation mechanism 34 by a controller 41 (see FIG. 2) on the basis of a detection signal of the drawing roller position detector S2. This position of the document tray 22 on standby can be optionally set by the operation of an operation unit 46 (see FIG. 2) in accordance with the number of the documents frequently set in the document tray 22 in a daily general usage state, and a service person or the user can set it in advance.

Further, as described above, the document tray 22 can be elevated and displaced in the range between a height position at the inlet side of the curved carrier path 23 to be naturally formed by the curved carrier path 23 set capable of securing the stable carriage of the document and a height position at the outlet side thereof. In the case that the document tray 22 moves in a lower direction, an interval between the document tray 22 and the drawing roller R1 is made larger, so that it is possible to mount a large amount of documents and, further, it is possible to sequentially feed the document by rising one sheet on the uppermost layer of a large amount of document bundles that are mounted on the document tray 22 to a position capable of being fed to the inlet of the curved carrier path 23.

In addition, the document tray 22 is provided with a document regulatory plate 30 for regulating and aligning the side of the document bundle, and the position of this document regulatory plate 30 is detected by a first document size detector S0 for detecting a wide (a length in a direction orthogonal to a direction of feeding a document) of the document. In the meantime, the document tray 22 is also provided with a second document size detector S7 having an actuator S7*a* and a sensor body S7*b* for detecting a length of the document (a length of a direction of feeding a document). By these first and second document size detector S0 and S7, the size of the document mounted on the document tray 22 is detected and, on the basis of this detection result, a printer sheet upon forming an image or the like is performed and this detection result is also used for controlling a height of the document tray 22 by the controller 41 (see FIG. 2).

On the other hand, upon reading the document on the document table 12, the light source unit 13 may move a certain distance in accordance with the document size that is detected by a third document size detector S9 for detecting the size of the document that is mounted on the document table 12 in a direction from a position Pos3 (a start position of the light source unit 13 upon reading the static document, hereinafter, referred to as a third position) to a position Pos4 (a return position of the light source unit 13 upon reading the largest document, hereinafter, referred to as a fourth position) in FIG. 1.

On the contrary, upon reading the carried document, the light source unit 13 stops at the first reading position Pos1 (at a position of the light source unit 13 upon reading a traveling document). In addition, the light source unit 13 defines one of a middle position between the third position Pos3 and the fourth position Pos4 and a middle position between the third position Pos3 and the first reading position Pos1 as a home position on the basis of the detection result of a light source unit detector S8 for detecting the position of the light source unit 13. Accordingly, when the light source unit 13 is not used, namely, on standby, the light source unit 13 stops at this home position.

In the meantime, in order to read the document mounted on the document table 12, in the ADF 3, a portion at a back side of the image reading apparatus 1 (a back side in FIG. 1) is rotatably supported by a hinge (not illustrated) that is provided between the ADF 3 and the optical system 2. The ADF 3 rotates upward against the document table 12 and opens around this hinge as a rotation supporting point. In other words, rotating upward and opening the ADF3, the upper side of the document table 12 of the image reading apparatus 1 can be released from a front side in FIG. 1, and this makes it possible to set a document that is not a sheet type and cannot be carried by the ADF 3, for example, a document such as a book type or the like on the document table 12. In the meantime, on a bottom surface of the ADF 3, namely, on a surface contacting the document table 12, a document mat 25 that is made of an elastic material is provided opposed to the document table 12. In addition, this opening/closing state of the ADF 3 may be detected by an ADF opening/closing detector 28 that is provided at the side of the optical system 2.

The image reading apparatus 1 that is configured as described above can read the document in three modes, namely, a static reading mode, a traveling reading mode, and a double-sided reading mode. The static reading mode serves to read the document such as a book and, in this mode, the image reading apparatus 1 may read the document mounted on the document table 12 by means of the CCD reading unit 11 while scanning the light source unit 13 and the mirror unit 14 in a direction indicated by the arrow 15. In addition, both of the traveling reading mode and the double-sided reading mode serve to read the documents set on the document tray 22 while feeding them automatically by the ADF 3 one by one. In the meantime, in the traveling reading mode, by using the CCD reading unit 11, and in the double-sided reading mode, by using both of the CCD reading unit 11 and the CIS 21, the documents are read respectively.

Here, the processing upon occurrence of the carrying jam of the document will be described below. When the carrying jam is caused, the image reading apparatus 1 may be brought to an emergency stop. In this case, whether or not the document carried for reading has been completely read and whether or not the document stays in the carrier path between the reader (the light source unit 13, the CIS 21) and the document tray 22 are displayed on an operation panel P of the operation unit 46 (see FIG. 3), and on the basis of the displayed contents, the user may perform the jam processing on the basis of his or her judgment.

The completely read documents are removed from the carrier path at the upstream side of the reader and they cause the carrying jam at the downstream side of the reader. In this case, by releasing the ADF 3 upward, the staying documents are removed therefrom. The removed documents are not necessarily returned to the document tray 22 since they have been completely read. Then, it is detected by the ADF opening/closing detector 28 that the ADF 3 has been opened/closed, and if it is detected by the discharging detector S6 that there is no document staying on the carrier path, an emergency stop state due to the carrying jam is released.

In the case that the document is staying within the carrier path at the upstream side of the reader, releasing the outer cover 26 as shown by a broken line in FIG. 1, the document is taken out. If it is detected that the document is staying by the feeding detectors S3, S4 and S5, guidance for opening the outer cover 26 is displayed on the operation panel P (see FIG. 3). As a result, the user removes the staying document by releasing the outer cover 26 in accordance with this guidance to perform the jam processing. In addition, when it is detected that the document is staying by the feeding detectors S3, S4 and S5 after the emergency stopping, the document tray 22 is allowed to move down and stop by a predetermined amount (for example, a preset amount, or an amount capable of returning the removed document to the document tray 22). According to the present embodiment, taking its cues from detecting. that the outer cover 26 opens and closes by the outer cover opening/closing detector 27, the moving down operation of this document tray 22 is performed. This intends to strongly appeal to the user that he or she should return the document by moving down the document tray 22 after the user sees the guidance for releasing the outer cover 26 and taking out the document so as to return the document to the document tray 22.

When the document does not reach the feeding detector S3 located at the most upstream side among the detectors for detecting the carriage state of the document and the carrying jam is caused, the drawing roller R1 and the separation roller R2 are slipped in many cases, and in such a case, as maintaining a position of the document tray 22, it is displayed on the operation panel P (see FIG. 3) to check the document tray 22. In addition, since sometimes the document is bent and gets stuck, it may be displayed to check the document on the document tray 22 by moving down the document tray 22 with the operation of an up/down key K0 (see FIG. 3).

In the meantime, according to the present embodiment, the largest number of the documents capable of being set on the document tray 22 is for example about 200 in a normal thickness of a copying sheet.

FIG. 2 is a block diagram showing a functional structure of the image reading apparatus 1 according to an embodiment of the present invention. In the meantime, in FIG. 2, the identical reference numerals are given to the identical or corresponding parts as or to the configuration shown in the above-described FIG. 1 and their explanations are herein omitted.

To the controller 41 realized by a microcomputer or the like, the detection results of the first and second document size detectors S0, S7 for detecting the size of the document set on the document tray 22, and the third document size detector S9 for detecting the size of the document set on the document tray 12 are supplied. The controller 41 may change over control of a sheet to be used and timing on the basis of the detection results of these document size detectors S0, S7 and S9.

Upon reading the document by using the CCD reading unit 11, the controller 41 may drive and control the stepping motor 42 to move the light source unit 13 and the mirror unit 14 as described above, and further, the controller 41 may control the exposure lamp 13*a* and the CCD 11*b* in accordance with the position of the light source unit 13 that is detected by the light source unit detector S8 to read the image of the document.

On the contrary, upon reading the document by using the ADF 3, maintaining the height of the uppermost side of the document bundle set in the document tray 22 by driving and controlling the elevation motor 33 on the basis of the detection result of the drawing roller position detector S2 and carrying the document by controlling the document carrier motor 43, the drawing roller clutch 44 of the drawing roller R1, and the resist roller clutch 45 of the resist rollers R8, R9 on the basis of the detection results by the respective detectors S3 to S6 until the document detector S1 detects that all documents are removed from the document tray 22, the controller 41 may control the CCD 11*b* and/or the CIS 21 to read the image of the document.

In addition, the controller 41 may allow the operation unit 46 that is composed of a liquid crystal touch panel or the like to display the necessary information and further, it may receive the input operation to be added to the operation unit 46.

Figure 3:
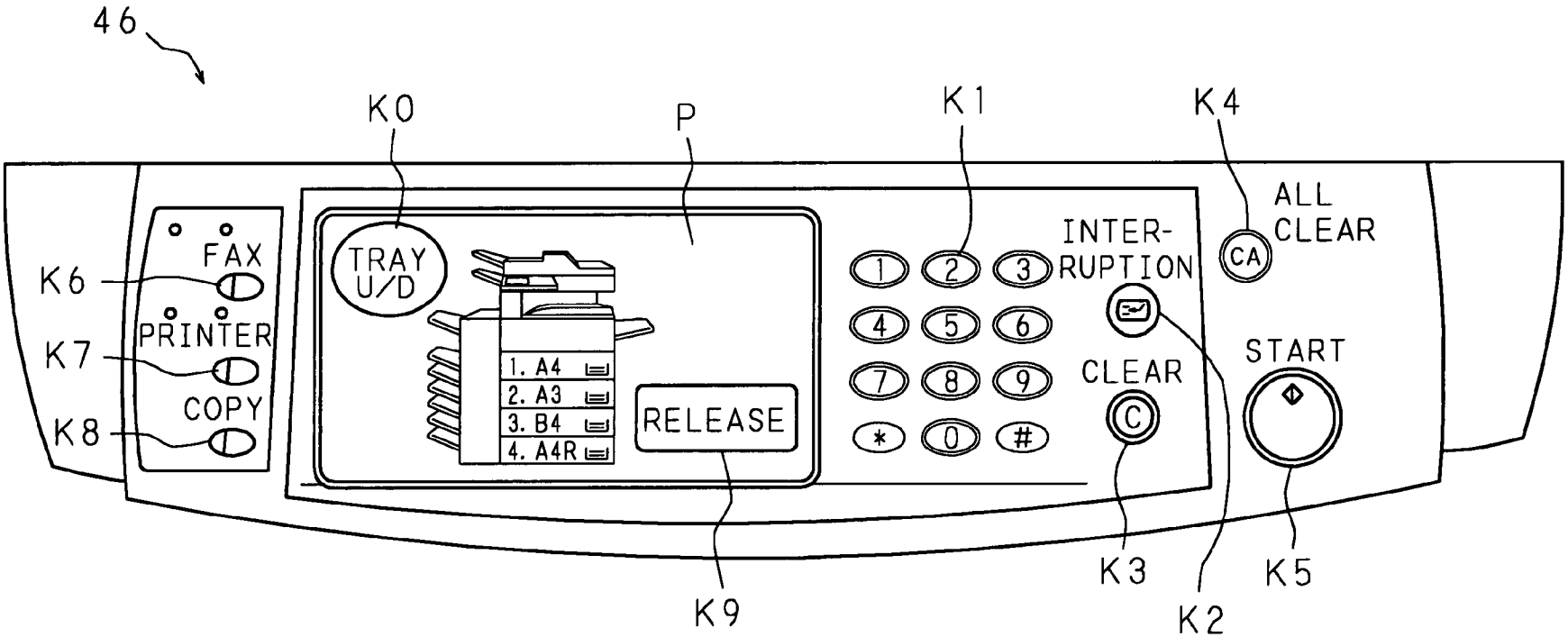
FIG. 3 is a schematic view showing one constitutional example of an operation unit of the image reading apparatus according to the present invention.

FIG. 3 is a schematic view showing one constitutional example of the operation unit 46 of the image reading apparatus 1 according to the present invention. The operation unit 46 is disposed on the upper side of the image reading apparatus 1 (not illustrated in FIG. 1) and the operation unit 46 is provided with various hardware keys K1 to K8 and an operation panel P that is configured by the liquid touch panel or the like.

Among various hardware keys K1 to K8 provided to the operation unit 46, K1 is a numeric keypad for inputting numbers, K2 is a key for the interruption. process, K3 is a clear key, K4 is an all clear (all release) key, K5 is a start key for starting reading of the document, K6, K7 and K8 are function changing-over keys for selecting a facsimile function, a printer function and a copy function.

On a screen of the operation panel P, various screens are displayed with changed over, and various guidance and warning for the operation are also displayed on the screen of this operation panel P. Among these screens, various software keys for setting various conditions are arranged. According to the example shown in FIG. 3, the up/down key K0 for adjusting the height of the document tray 22 is displayed on the operation panel P. If this up down key K0 is operated on standby, driving the elevation motor 33, the controller 41 may elevate and displace the document tray 22 as described above, and this enables the height of the document tray 22 to be adjusted. The elevation and the displacement of the document tray 22 are carried out step by step by a predetermined height for each operation of the up/down key K0.

In addition, on the operation panel P, a release key K9 for releasing the emergency stop state by the carrying jam when the jam processing is completed is displayed. After this release key K9 is pushed down, if staying of the document is not checked in respective detectors S3 to S6, the emergency stop state is released, and the emergency stop state may shift to a standby state capable of restarting the carrier operation and the reading operation.

In the meantime, according to the present embodiment, the up/down key K0 and the release key K9 are provided on the operation panel P shown in FIG. 3; however, for example, the up/down key K0 and the release key K9 may be provided as a push button type switch at an appropriate position in the vicinity of the document tray 22 on the ADF 3.

Figure 4:
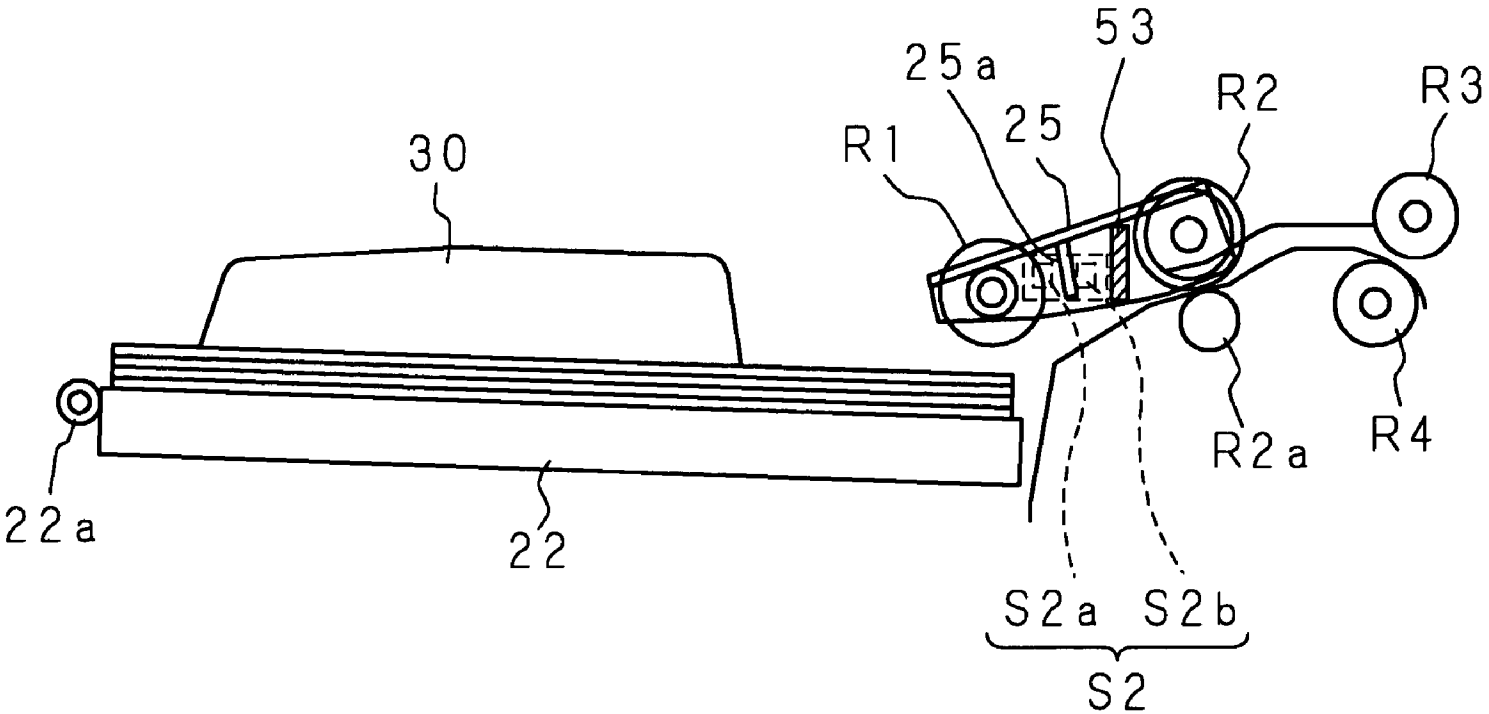
FIG. 4 is a schematic side view showing a mechanical constitutional example around a document tray for explaining the operation upon adjusting a height of the document tray of the image reading apparatus according to the present invention.
Figure 5:
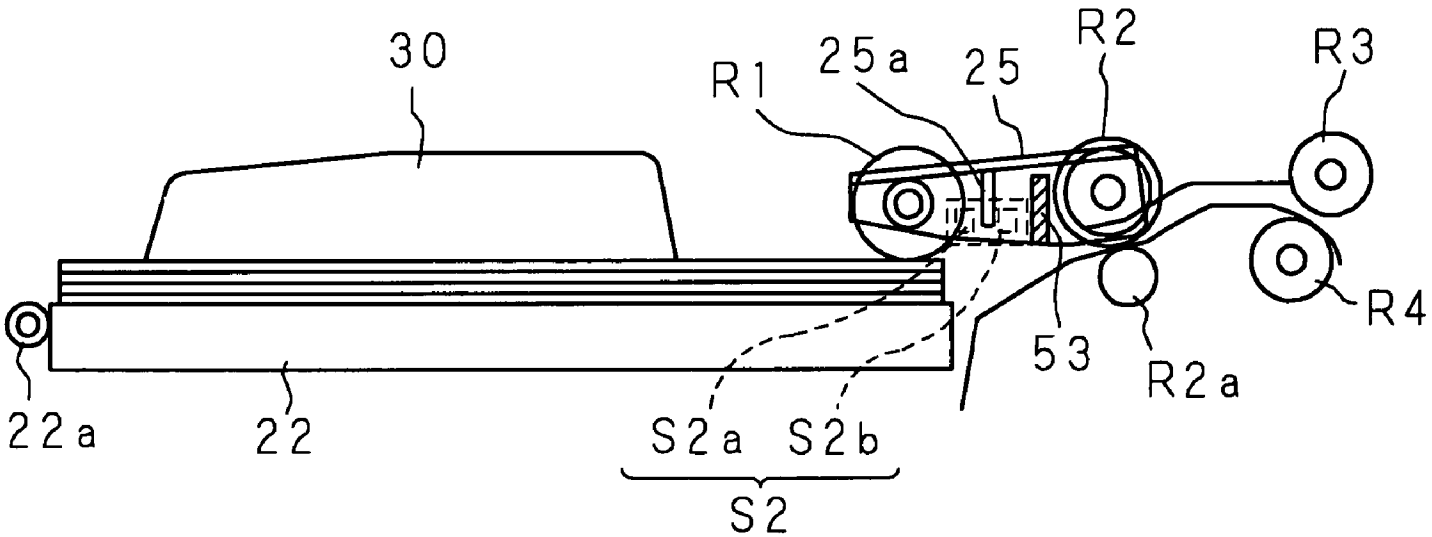
FIG. 5 is a schematic side view showing a mechanical constitutional example around a document tray for explaining the operation upon adjusting a height of the document tray of the image reading apparatus according to the present invention.
Figure 6:
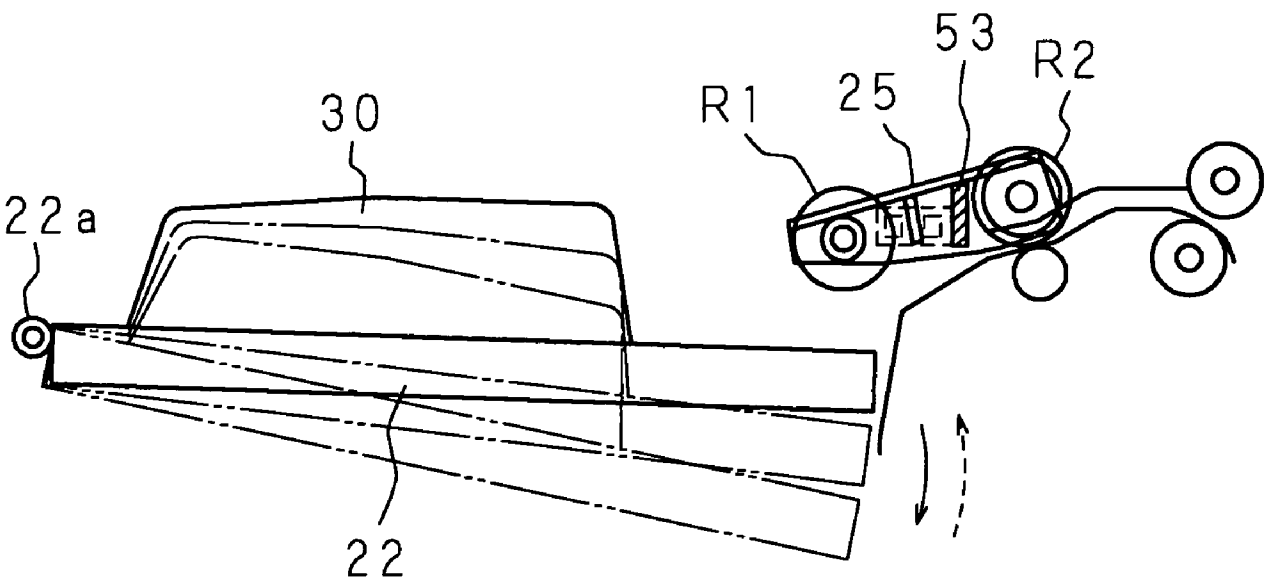
FIG. 6 is a schematic side view showing a mechanical constitutional example around a document tray for explaining the operation upon adjusting a height of the document tray of the image reading apparatus according to the present invention.

FIGS. 4, 5 and 6 are schematic side views each showing a mechanical constitutional example around the document tray 22 for explaining the operation upon adjusting the height of the document tray 22.

For example, it is assumed that the height of the document tray 22 and the mounting amount of the document are as shown in FIG. 4, and a douser 25*a* of the arm 25 intervenes between a pair of a light-emission element S2*a* and a light-sensitive element S2*b* of the drawing roller position detector S2 and a light path between two elements S2*a* and S2*b* is not formed, namely, the drawing roller position detector S2 is turned off.

Under such a state, moving upward the document tray 22, the document tray 22 is stopped under the state as shown in FIG. 5 such that the douser 25*a* of the arm 25 does not intervene between the pair of the light-emission element S2*a* and the light-sensitive element S2*b* of the drawing roller position detector S2 and the light path between two elements S2*a* and S2*b* is formed, namely, the drawing roller position detector S2 is turned on. Under such state, the drawing roller R1 may contact the uppermost layer of the document bundle by its own weight or an energization force of the drawing roller R1 and the arm 25.

The document tray 22 is held at a height in accordance with the number of the documents with the highest frequency of usage, and when the document is set on the document tray 22 at this height, the front end of the document may abut against the drawing roller R1 so that the document cannot be set correctly. In such a case, the user may operate the up/down key K0. By the operation of the up/down key K0, as shown in FIG. 6, for each operation, the document tray 22 moves down step by step, and when the operation of the up/down key K0 is performed after the document tray 22 reaches the lowest position, the document tray 22 will return to the height in accordance with the number of the documents with the highest frequency of usage. Depending on such operation, it is possible to set the document tray 22 at the height in accordance with the number of the documents to be set.

In the meantime, the document tray 22 may be moved down step by step by a predetermined height for each operation, however, differently from this, during the operation of the up/down key K0 (for example, the up/down key has been continuously pushed down), the document tray 22 may be moved down in a single step. In such a case, it is possible to set the height of the document tray 22 in accordance with the number of the documents with a high degree of accuracy. In addition, the document tray 22 may be moved down to the lowest position by one operation of the up/down key K0. Further, the key to operate elevation of the document tray 22 is not limited to the up/down key K0 and for example, this elevation operation function may be provided to the all release key K4.

Figure 7:
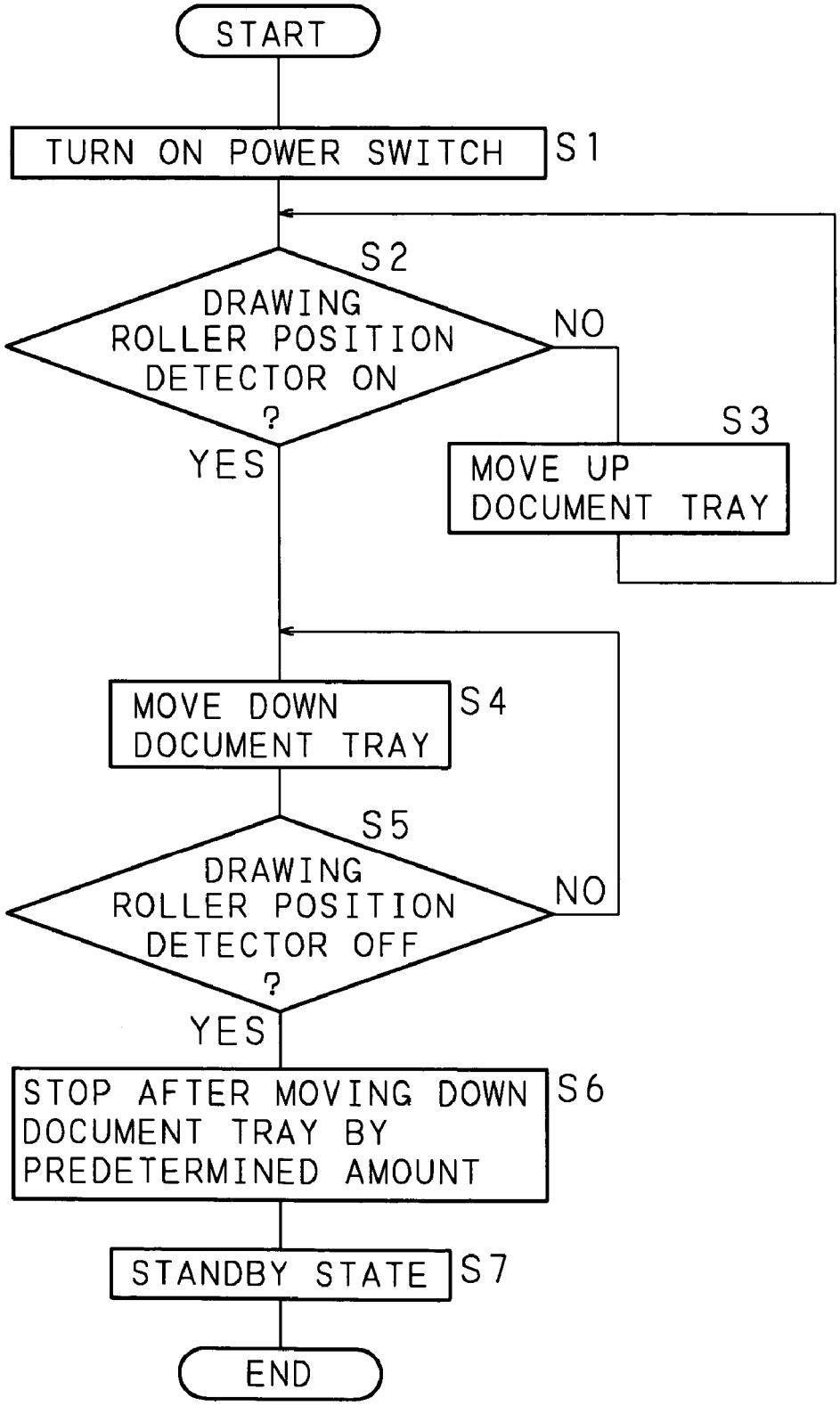
FIG. 7 is a flowchart showing a control procedure of a controller in the elevation operation of the document tray of the image reading apparatus according to the present invention.

The operation of the image reading apparatus 1 having the above-described structure will be described below with reference to a flowchart. FIG. 7 is a flowchart showing a control procedure of the controller 41 from a power switch of the document tray 22 is turned on till it becomes on standby.

At first, when the power switch (not illustrated) is turned on (step S1), the controller 41 may determine whether or not the output of the drawing roller position detector S2 is ON, namely, the light path is formed between the elements S2*a* and S2*b* (step S2). In the case that the output of the drawing roller position detector S2 is OFF (S2: NO), the controller 41 may drive the elevation motor 33 to move up the document tray 22 (step S3).

In the case that the output of the drawing roller position detector S2 is ON (S2: YES), the controller 41 may drive the elevation motor 33 to move down the document tray 22 (step S4). Then, when the output of the drawing roller position detector S2 is OFF (step S5: YES), the controller 41 may drive the elevation motor 33 and it may stop after moving down the document tray 22 by a predetermined amount (step S6) and then, it may become on standby (step S7). If the output of the drawing roller position detector S2 is not OFF (step S5: NO), the operation will return to S4.

The height of the document tray 22 on standby is set in advance through the operation unit 46 by a service person or the user at the height selected from among plural heights or at an arbitrary height in accordance with the number of the documents with the highest frequency of setting as shown in FIG. 6.

In the meantime, the flowchart till standby of FIG. 7 explains the control procedure without using a detector for directly detecting the position of the document tray 22, however, the height of the document tray 22 may be adjusted by using the detector for directly detecting the position of the document tray 22. For example, providing the detector for detecting the lowest position in the range of elevation of the document tray 22, the position of the document tray 22 may be set by moving the document tray 22 in a direction represented by a broken line of FIG. 6 so that the document tray 22 is located at the height of an initial state (a standby state) thereof that is set in advance on the basis of a detection signal of the detector. Alternatively, providing the detector for detecting the highest position in the range of elevation of the document tray 22, the document tray 22 may be moved in a direction represented by a solid line of FIG. 6. Generally, the height of the document tray 22 at the initial state (the standby state) is the lowest position capable of mounting the largest volume of documents, however, it is also possible to set the document tray 22 at an arbitrary height.

Figure 8:
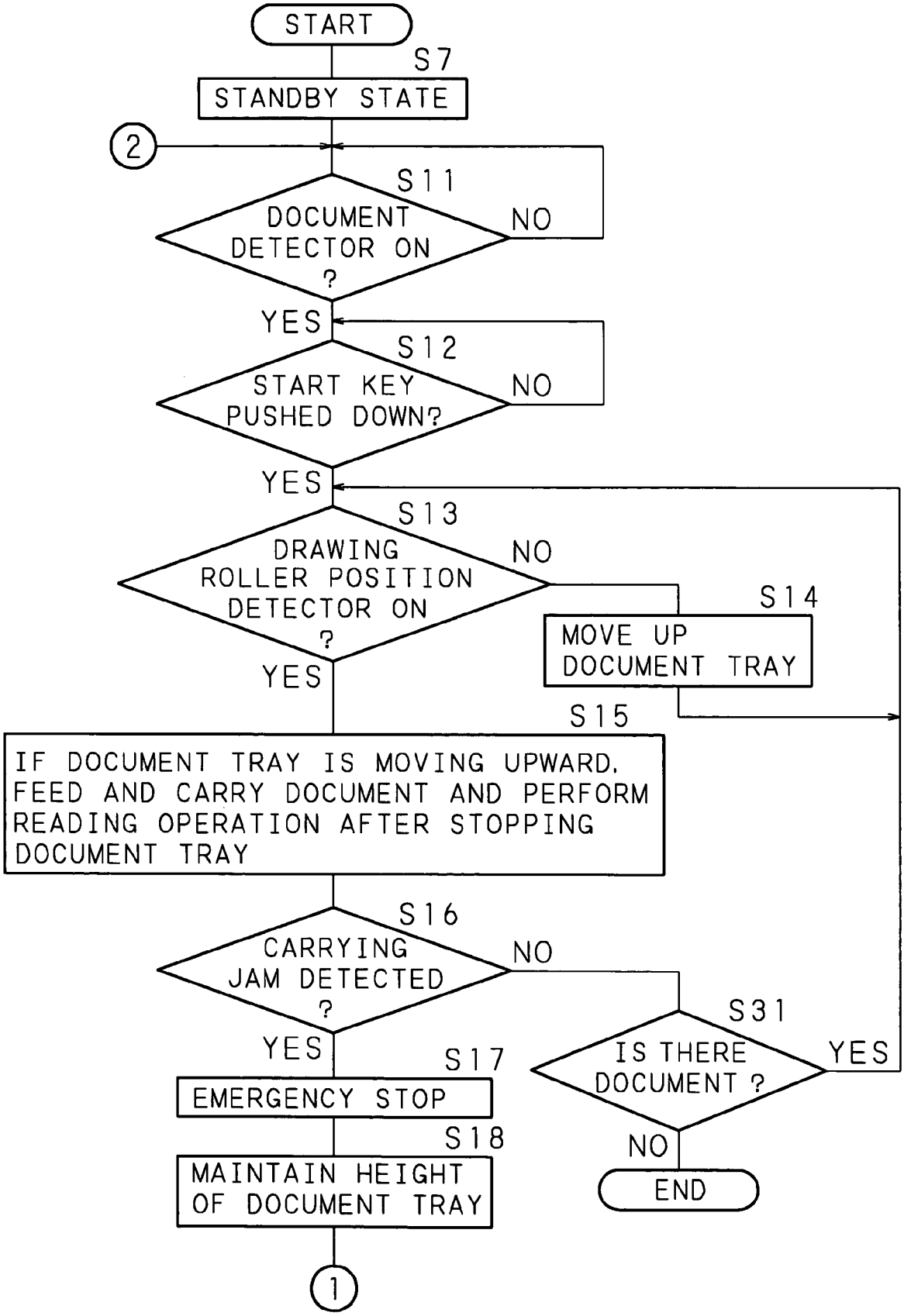
FIG. 8 is a flowchart showing a control procedure of a controller in the elevation operation of the document tray of the image reading apparatus according to the present invention.
Figure 9:
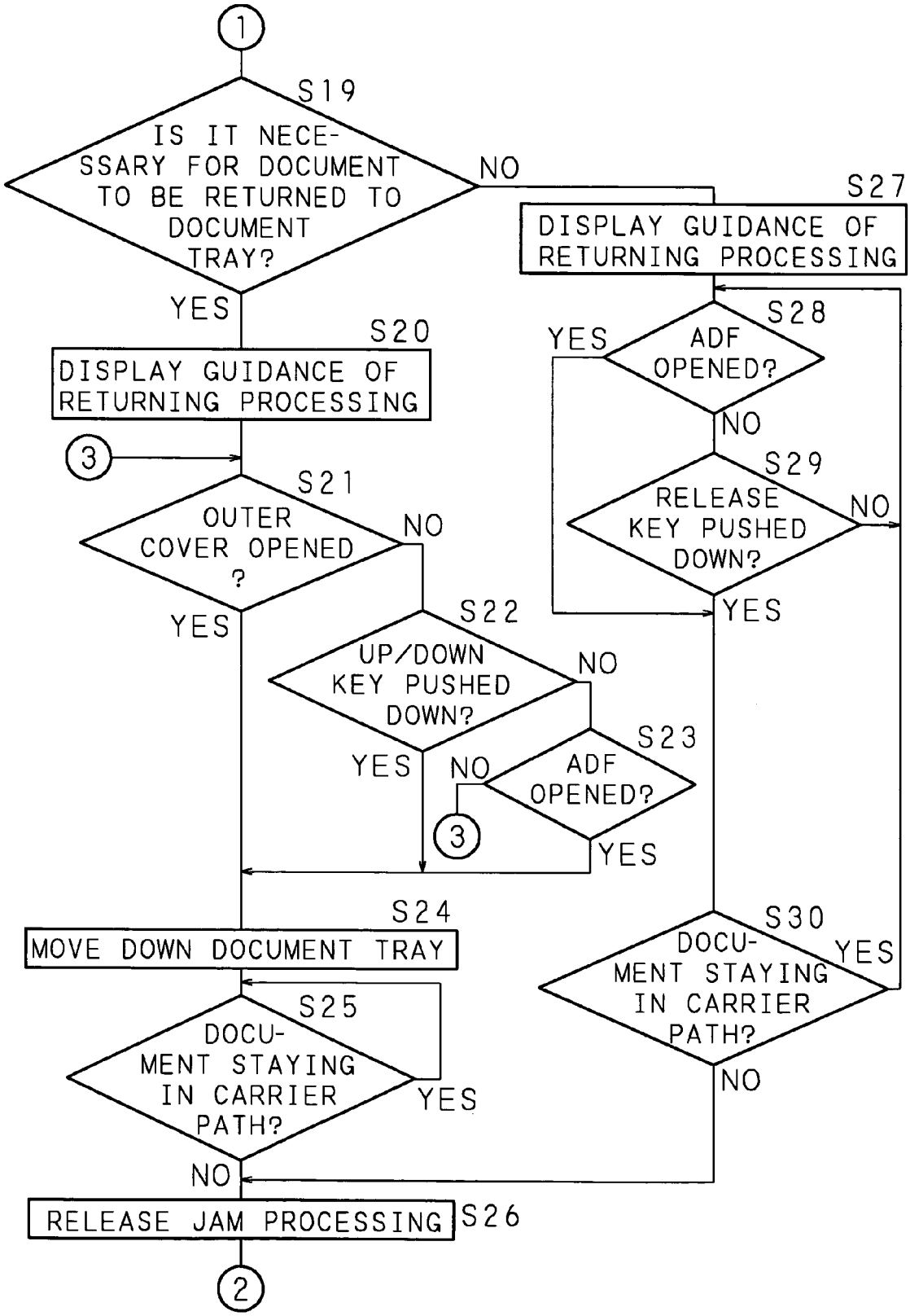
FIG. 9 is a flowchart showing a control procedure of a controller in the elevation operation of the document tray of the image reading apparatus according to the present invention.

Each of FIGS. 8 and 9 is a flowchart showing a control procedure of the controller from setting of the document till reading of the image (including the jam processing). As described above, it is assumed that the document tray 22 is on standby (S7).

At first, the controller 41 may determine whether or not the document is set on the document tray 22 by determining whether or not the output of the optical document detector S1 is ON (step S11). If the output of the optical document detector S1 is ON (step S11: YES), the controller 41 may determine whether or not reading is instructed by determining whether or not the start key K5 is pushed down (step S12).

When the start key K5 is pushed down (S12: YES), the controller 41 may determine whether or not the output of the drawing roller position detector S2 is ON (step S13). If it is OFF (S13: NO), the controller 41 may drive the elevation motor 33 to move up the document tray 22 (step S14). Then, when the output of the drawing roller position detector S2 is ON (step S13: YES), if the document tray 22 is moving upward, the controller 41 may feed the document to the carrier path and perform reading operation after stopping the document tray 22 (step S15).

The controller 41 may determine whether or not the carrying jam is caused during the reading operation (S16: NO). If no carrying jam is caused (S16: NO), the controller 41 may determine whether or not there is a document on the basis of the output of the drawing roller position detector S1 (step S31), and if the document remains (S31: YES), the procedure returns to S13, and if no document remains (S31: NO), the entire procedure terminates.

If the carrying jam is caused (S16: YES), the image reading apparatus 1 is brought to an emergency stop (step S17). The controller 41 maintains the document tray 22 at the height as it is without driving the elevation motor 33 (step S18). Then, the controller 41 determines whether or not it is necessary for the document causing the carrying jam to be removed and to be returned to the document tray 22 (step S19).

If it is necessary to return it to the document tray 22 (S19: YES), the controller 41 displays guidance of return processing including the instruction to return the document to the document tray 22 on the operation panel P of the operation unit 46 (step S20). Next, the controller 41 determines whether or not the outer cover 26 is opened on the basis of the detection result of the outer cover opening/closing detector 27 (step S21). If the outer cover 26 is opened (S21: YES), the procedure proceeds to S24. If the outer cover 26 is not opened (S21: NO), the controller 41 determines whether or not the up/down key K0 is pushed down (step S22). If the up down key K0 is pushed down (S22: YES), the procedure proceeds to S24. When the up/down key K0 is not pushed down (S22: NO), the controller 41 determines whether or not the ADF 3 is opened on the basis of the detection result of the ADF opening/closing detector 28 (step S23). If the ADF 3 is opened (S23: YES), the procedure proceeds to S24. If the ADF 3 is not opened (S23: NO), the procedure proceeds to S21.

Then, the controller 41 moves down the document tray 22 by driving the elevation motor 33 (step S24). Determining whether or not the document stays in the carrier path (step S25), if no document stays there (S25: NO), the controller 41 releases the jam processing (step S26), the procedure returns to S11. When there is a document staying there (S25: YES), the procedure returns to S25 again and till there is no document staying in the carrier path, the controller 41 continuously determines whether or not the document stays in the carrier path.

On the other hand, when there is no necessity to return the document to the document tray 22 (S19: NO), the controller 41 displays guidance of returning processing including the instruction to notice that the document is not necessarily returned to the document tray 22 on the operation panel P of the operation unit 46 (step S27). Next, the controller 41 determines whether or not the ADF 3 is opened on the basis of the detection result of the ADF opening/closing detector 28 (step S28). If the ADF 3 is opened (S28: YES), the procedure proceeds to S30. If the ADF 3 is not opened (S28: NO), the controller 41 determines whether or not the release key K9 is pushed down (step S29). If the release key K9 is pushed down (S29: YES), the procedure proceeds to S30. When the release key K9 is not pushed down (S29: NO), the procedure proceeds to S28.

Determining whether or not the document stays in the carrier path (step S30), if there is no document staying there (S30: NO), releasing the jam processing (S26), the procedure returns to S11. If there is the document staying there (S30: YES), the procedure returns to S28.

In S15 of the above-described flowchart, the procedure to carry the document one by one and read the document is described by one step, however, in accordance with feeding and carrier of the document, the height of the uppermost part of the document is gradually lowered in detail. Therefore, checking a signal of the drawing roller position detector S2, when the carrier level (the height of the uppermost part of the document) is lowered, the document tray 22 is moved up, and the reading operation has been continued while maintaining a carrier level constantly at an appropriate level that is set in advance. During this reading operation, it is monitored whether or not the clear key K3, the interruption key K2, and the all release key K4 are handled, and if the operations of respective keys are carried out, the procedure in accordance with the carried out processes of respective keys is performed, however, such procedure is omitted in the above-described flowchart.

In S19 of the above-described flowchart, since the processing by the user to be performed when the carrying jam is caused and the image reading apparatus 1 is brought to an emergency stop is different depending on a staying position of the document, it is determined whether or not the staying document is necessarily returned to the document tray 22. Based on whether or not the document staying in the carrier path has been read, the judgment at S19 is carried out. Specifically, when the feeding detectors S3, S4 and S5 detect that the document is staying, and when the discharging detector S6 detects that the document is staying and reading of this document has not been completed, determining that reading of other documents has not been completed yet and the document is necessarily returned to the document tray 22, the document is removed and the guidance of returning it to the document tray 22 is displayed on the operation panel P for the user (S20). On the other hand, when the discharging detector S6 detects staying of the document and reading of this document has been completed, determining that reading of other documents has been completed and the document is not necessarily returned to the document tray 22, the guidance of releasing the ADF 3 and removing the document is displayed on the operation panel P for the user (S27).

In addition, there is no description on the flowcharts shown in FIGS. 8 and 9, however, if any of the detectors S3 to S6 does not detect staying of the document, it is determined that drawing of the document is not performed correctly and the guidance of checking a layered state of the document on the document tray 22 is displayed on the operation panel P. In such a case, moving down the document tray 22 by the up/down key K0, it is possible to make the document into a state capable of being easily checked.

In S26 of the above-described flowchart, in the case that it is not detected that the document stays in the carrier path as described above after handling the outer cover opening/closing detector 27, the ADF opening/closing detector 28, and the release key K9 of the operation panel P, namely, in the case that respective detectors S3 to S6 do not detect staying of the document, the jam processing is released, a guidance screen related to the jam processing that is displayed on the operation panel P is cleared, and at last, the reading can be restarted. Then, the reading operation will be restarted by the operation of the start key K5.

According to the above-described example, the embodiment applying the sheet feeder according to the present invention to the image reading apparatus is described, however, the sheet feeder according to the present invention also can be applied to an image forming apparatus such as a copying machine and a printer or the like and a complex machine or the like having a scanner function, a printer function, and a facsimile function.

Figure 10:
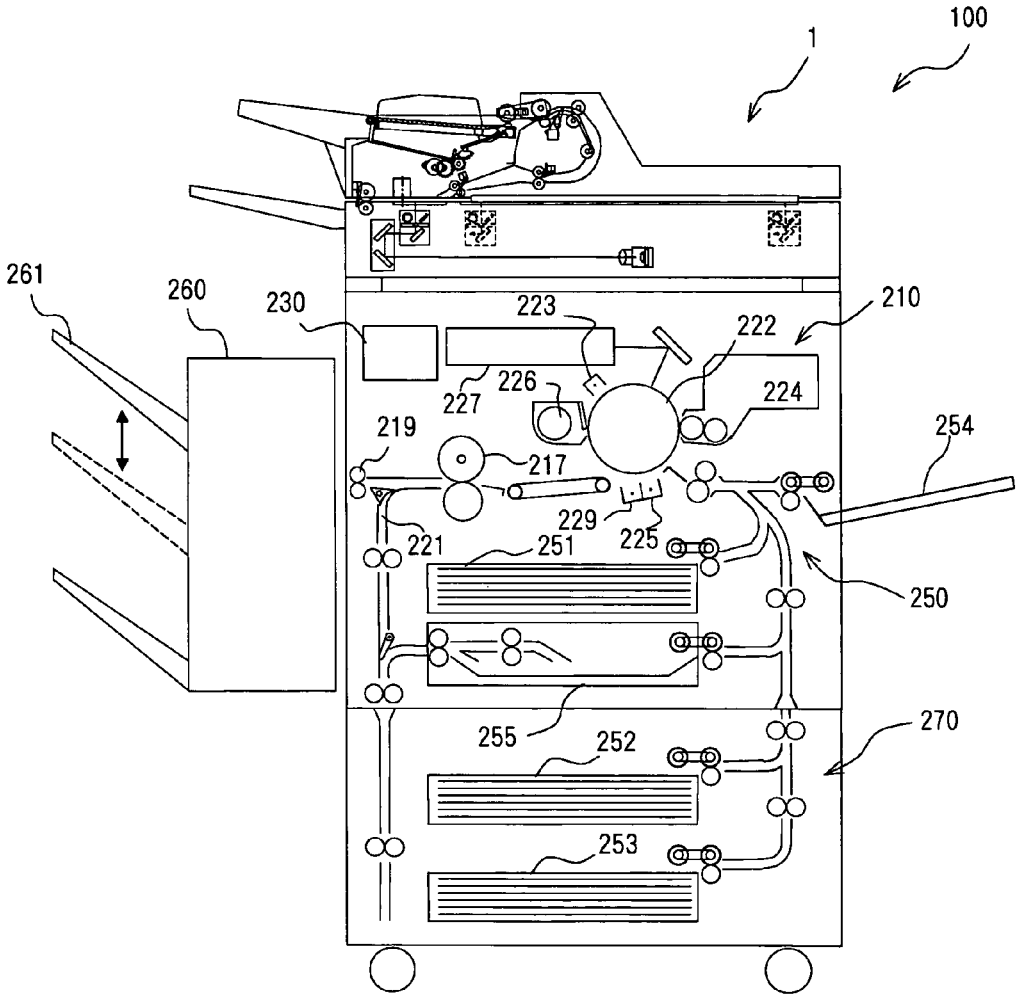
FIG. 10 is a longitudinal sectional view showing a schematic structure of an image forming apparatus according to the present invention.

FIG. 10 is a longitudinal sectional view showing a schematic structure of an image forming apparatus according to the present invention. This image forming apparatus 100 is provided with the image reading apparatus 1, an image forming unit 210 for forming an image on paper, a post-processing unit 260 for applying the post-processing to the paper having the image formed thereon, and a feeding unit 270 for feeding and carrying the paper to the image forming unit 210. The image forming unit 210 is disposed at a lower part of the image reading apparatus 1, and the post-processing unit 260 and the feeding unit 270 are disposed at a side part and a lower part of the image forming unit 210, respectively.

The image forming unit 210 has a function to form an image on the paper fed from the feeding unit 270 on the basis of the image data that is acquired by reading the image of the document by the image reading apparatus 1 or the image data that is transferred from an outer information processing apparatus (not illustrated). Specifically, the above-described image data is transmitted to an image processing unit (not illustrated) and is applied with the predetermined image processing, and then, this image data is stored in an image memory within the image processing unit once to be sequentially read at a predetermined timing and to be transferred to a laser writing unit 227 as an optical writing apparatus.

The laser writing unit 227 is configured by a semiconductor laser light source irradiating laser light in accordance with the image data that is transferred from the image memory, a polygon mirror for deflecting the laser light with a conformal rate, and a f-θ lens correcting the deflected laser light with a conformal rate so as to be deflected at a conformal rate on a photosensitive drum 222. In the meantime, according to the present embodiment, the laser writing unit 227 is used as an optical writing apparatus, however, it is possible to use an optical writing head unit of a fixed scanning type using a light emitting element array such as an LED (Light Emitting Diode) and an EL (Electro Luminescence) or the like.

Around the photosensitive drum 222, an electrification device 223 for charging the photosensitive drum 222 at a predetermined electric potential, a developing unit 224 for feeding toner to an electrostatic latent image that is formed on the photosensitive drum 222 and developing it, a transcriber 225 for transcribing a toner image that is formed on the photosensitive drum 222 on a carried paper, a static eliminator 229 for peeling off the photosensitive drum 222 from the paper, and a cleaner 226 for retrieving the remaining toner after transcribing the toner image are arranged. The paper having the image formed thereon is carried to a fixing unit 217 and the image is fixed on the paper by the fixing unit 217. The paper having the image fixed thereon is discharged to the outside by a discharging roller 219.

At the downstream side in a paper carrying direction of the discharging roller 219, a post-processing unit 260 for performing the staple processing and the inner folding processing or the like to the paper having the image formed is provided, and the paper introduced to a post-processing unit 260 is discharged on an elevation tray 261 after being provided with the predetermined post-processing. Further, the image forming unit 210 is provided with a paper tray 251 and a manual feed tray 254 for taking in an arbitrary paper from the outside. Then, the paper that is fed from the paper tray 251 or the manual feed tray 254 is carried to an image transcription position where the photosensitive drum 222 and the transcriber 225 or the like are arranged by a paper carrier 250.

In addition, at the downstream side in a paper carrying direction of the fixing unit 217, a switchback path 221 to be used upon forming an image on a rear side of the paper is provided. The paper that is inverted by the switchback path 221 is fed to a unit 250 for carrying a paper again through a double-sided unit 255. In the meantime, the switchback path 221 and the double-sided unit 255 are used not only upon forming images on the double sides of the paper but also upon inverting a front surface and a rear surface of the paper and discharging it.

The feeding unit 270 arranged on the lower part of the image forming unit 210 is provided with a plurality of paper cassettes 252 and 253 connected to the paper carrier 250 of the image forming unit 210 to contain a large amount of paper having different sizes. On the image forming apparatus 100, a controller 230 is mounted, which operates the above-described respective parts in liaison with each other, in order to form an image on the paper fed from the feeding unit 270 to the image forming unit 210 on the basis of the image of the document that is read by the image reading apparatus 1.

As described above, in the sheet feeder according to the present invention, when this sheet feeder stops by the carrying jam of the sheet, in accordance with the carriage state of the jammed sheet, the sheet container is controlled so as to be maintained at a position as it is or to be moved down, so that it is possible to evade wasteful operation to the sheet container and to shorten a processing time by performing efficient processing.

In addition, in the sheet feeder according to the present invention, when the jammed sheet is not necessarily returned to the sheet container, the sheet is maintained at a position as it is, and when the jammed sheet should be returned to the sheet container, the sheet container is moved down. Therefore, in the case that the carrying jam is released to start the sheet feeder again, the wasteful operation is not necessarily performed and it is possible to perform the processing efficiently and to shorten the processing time.

In addition, in the sheet feeder according to the present invention, since it is decided that the sheet container is moved down or the sheet container is remained as it is based on whether or not the sheet feeder receives the predetermined operation, as compared to the apparatus for performing the same operation (the moving-down processing) in any case, this sheet feeder is not needed to perform the waste operation, so that the present sheet feeder can evade wasteful operation to the sheet container, can shorten a processing time, and can perform the efficient processing.

In addition, in the sheet feeder according to the present invention, the elevation operation receiver determines that the sheet is necessarily returned to the sheet container when it is operated by the user to move down the sheet container, so that it is possible to easily perform the processing to return the sheet.

In addition, in the sheet feeder according to the present invention, since it is determined whether or not the sheet is necessarily returned to the sheet container on the basis of the detection result of the opening/closing detector of the cover member of the carrier path, it is possible to easily determine whether or not the sheet should be returned to the sheet container.

In addition, in the sheet feeder according to the present invention, in the case that the detector located at the uppermost stream side of the carrier path does not detect the sheet, it is determined that the sheet is not fed and carried within the carrier path due to slip of the sheet carrier (the drawing roller, the separation roller) or the like, so that particularly, determining that there is no need to return the sheet to the sheet container, the sheet container is maintained at a position as it is and this evades the wasteful operation (the moving-down operation) so as to make the processing efficient.

In addition, in the sheet feeder according to the present invention, since the sheet container is controlled to allow the moving-down operation when the sheet feeder stops due to the occurrence of the carrying jam of the sheet, it is possible to easily check the mounted state of the sheet in the sheet container.

Since the image reading apparatus and the image forming apparatus according to the present invention are provided with the above-described sheet feeder, avoiding the wasteful operation when the sheet feeder stops due to the carrying jam, it is possible to shorten the processing time and it is possible to read the image on the sheet that is carried by the sheet carrier and to form an image that is read by the image reader.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bound of the claims, or equivalence of such metes and bounds thereof are therefore intended to be embraced by the claims.

What is claimed is:

1. A sheet feeder comprising:

a sheet container for containing a plurality of sheets in a stacked manner;

an elevator for moving up/down the sheet container;

a sheet carrier for carrying an abutted sheet to a carrier path when the sheet container is moved up by the elevator;

a carriage detector for detecting a carriage state of the sheet to be carried in the carrier path;

a determination unit for determining, when a carriage error of a sheet is caused within the carrier path, whether or not the sheet suffering from the carriage error is removed from the carrier path and needs to be returned to the sheet container; and a controller for controlling whether or not the sheet container is moved down on the basis of a result of determination by the determination unit.

2. The sheet feeder according to claim 1, wherein the controller remains the sheet container at a height as it is when the determination unit determines that the sheet does not need to be returned to the sheet container.

3. An image reading apparatus comprising:

the sheet feeder according to claim 2; and an image reader for reading the image on the sheet carried by the sheet carrier.

4. An image forming apparatus comprising:

the sheet feeder according to claim 2;

an image reader for reading an image of a sheet carried by the sheet carrier; and an image forming unit for forming the image that by the image reader on paper.

5. The sheet feeder according to claim 1, further comprising:

a receiver for receiving a predetermined operation from the outside, wherein the controller controls whether or not the sheet container is moved down based also on whether or not the receiver receives the predetermined operation.

6. The sheet feeder according to claim 5, wherein the receiver is an elevation operation receiver for receiving an elevation operation of the sheet container, and the controller moves down the sheet container when the elevation operation receiver receives the elevation operation, and the controller does not move down the sheet container when the elevation operation receiver does not receive the elevation operation.

7. An image reading apparatus comprising:

the sheet feeder according to claim 6; and an image reader for reading the image on the sheet carried b the sheet carrier.

8. An image forming apparatus comprising:

the sheet feeder according to claim 6;

an image reader for reading an image of a sheet carried by the sheet carrier; and an image forming unit for forming the image read by the image reader on paper.

9. An image reading apparatus comprising:

the sheet feeder according to claim 5; and an image reader for reading the image on the sheet carried by the sheet carrier.

10. An image forming apparatus comprising:

the sheet feeder according to claim 5;

an image reader for reading an image of a sheet carried by the sheet carrier; and an image forming unit for forming the image read by the image reader on paper.

11. The sheet feeder according to claim 1, wherein the sheet carrier has a cover member that can be freely opened/closed and covers the carrier path and an opening/closing detector for detecting opening/closing of the cover member, and the controller controls whether or not to the sheet container is moved down also on the basis of a result of detection by the opening/closing detector.

12. An image reading apparatus comprising:

the sheet feeder according to claim 11; and an image reader for reading the image on the sheet carried by the sheet carrier.

13. An image forming apparatus comprising:

the sheet feeder according to claim 11;

an image reader for reading an image of a sheet carried by the sheet carrier; and an image forming unit for forming the image read by the image reader on paper.

14. The sheet feeder according to claim 1, wherein the carriage detector has a plurality of carriage detectors arranged from the upstream side to the downstream side within the carrier path, and the determination unit determines whether or not the sheet needs to be returned to the sheet container based on whether or not a carriage detector arranged at the uppermost stream side among the plural carriage detectors detects a sheet to be carried.

15. An image reading apparatus comprising:

the sheet feeder according to claim 14; and an image reader for reading the image on the sheet carried by the sheet carrier.

16. An image forming apparatus comprising:

the sheet feeder according to claim 14;

an image reader for reading an image of a sheet carried by the sheet carrier; and an image forming unit for forming the image read by the image reader on paper.

17. An image reading apparatus comprising:

the sheet feeder according to claim 1; and an image reader for reading an image on the sheet carried by the sheet carrier.

18. An image forming apparatus comprising:

the sheet feeder according to claim 1;

an image reader for reading an image of a sheet carried by the sheet carrier; and an image forming unit for forming the image read by the image reader on paper.

19. A sheet feeder comprising:

a sheet container for containing a plurality of sheets in a stacked manner;

an elevator for moving up/down the sheet container;

a sheet carrier for carrying an abutted sheet to a carrier path when the sheet container is moved up by the elevator;

a carriage detector for detecting a carriage state of the sheet to be carried in the carrier path; and an allowing unit for allowing the moving-down operation of the sheet container by the elevator when a carriage error of a sheet is caused.

20. An image reading apparatus comprising:

the sheet feeder according to claim 19; and an image reader for reading the image on the sheet carried by the sheet carrier.

21. An image forming apparatus comprising:

the sheet feeder according to claim 19;

an image reader for reading an image of a sheet carried by the sheet carrier; and an image forming unit for forming the image read by the image reader on paper.

* * * * *